US005325022A

United States Patent [19]

Proctor

[11] Patent Number: 5,325,022

[45] Date of Patent: Jun. 28, 1994

[54] SINGLE, BI-COLOR ELEVATOR HALL ENUNCIATOR LANTERN

[75] Inventor: Charles J. Proctor, Mulan Court, Singapore

[73] Assignee: Otis Elevator Company, Farmington, Conn.

[21] Appl. No.: 937,094

[22] Filed: Aug. 31, 1992

[51] Int. Cl.[5] ..... H01J 1/60

[52] U.S. Cl. ..... 315/129; 187/137

[58] Field of Search ..... 362/800, 231; 187/130, 187/129, 135, 139, 138, 137, 136; 315/129

[56] References Cited

U.S. PATENT DOCUMENTS 5,194,702 3/1993 Swonger, Jr. ..... 187/130

FOREIGN PATENT DOCUMENTS 3-8677 1/1991 Japan .

*Primary Examiner*—James B. Mullins
*Assistant Examiner*—J. Dudek
*Attorney, Agent, or Firm*—M. P. Williams

[57] ABSTRACT

An elevator hall enunciator lantern includes an array (FIG. 2, FIGS. 4–8) of dual light, light emitting diodes 12–16, 56, 57 to be energized by a signal **35, 35*a* indicating the arrival of an up traveling elevator or the signal 36, 36*a* indicating the arrival of a down traveling elevator to provide a green indication or a red indication, respectively. The array may be configured so that the indication appears as an arrow 21, 22** pointing in the direction of the arriving elevator car. The indication may be scrolled (FIGS. 4–8) in the same direction as the direction of travel of the elevator car so as to provide an additional indication of the direction of travel of the arriving elevator car.

2 Claims, 3 Drawing Sheets

SINGLE, BI-COLOR ELEVATOR HALL ENUNCIATOR LANTERN

TECHNICAL FIELD

This invention relates to elevator hall enunciator lanterns which indicate both the up and down directions by emanating light of two different colors from a single area.

BACKGROUND ART

It has long been known to provide a separate light on each floor of a building to indicate the arrival of an elevator traveling in each direction (up, down). All of the floors except the highest and the lowest therefore have two separate lights. Typically, as soon as the elevator is committed to stop at the floor, the light on that floor indicating the direction in which the elevator is traveling is lit, and an audible announcement is sounded (such as a bell or chime). In more modern elevator systems, the lanterns may consist of arrays of light emitting diodes (LEDs); one such being used today having eight LEDs across and seven LEDs high in an orthogonal, co-aligned matrix, within a three or four inch rectangle. In order to provide proper service to such elevator systems, it is necessary to stock two different circuit sets, one for the down direction (typically red) and one for the up direction (typically white or green). In most elevator systems, elevator car position indicators are utilized on the main lobby floors to indicate to waiting passengers where each elevator is. In the more expensive elevator systems (such as may be used in luxury hotels and the like) it is also known to provide elevator car position indicators adjacent to doors on all of the floors. The position indicators originally were clock-like dials having a hand pointing to the floor position of the elevator car; then a series of lights, each one representing a floor and bearing a corresponding number, were utilized as a popular form of position indicator. More recently, position indicators have comprised a single display area within which different numerals are displayed. Although some of these are mechanical, today they are most likely to be electronic, formulated with LEDs and the like. In the highest and lowest floors of the elevator system (terminal floors), only one hall lantern is required, which permits utilizing the area that otherwise would be used for the hall lantern of an opposite direction to be used for a position indicator. This permits providing both the hall lantern and the position indicator in a single, unitary hall fixture. However, on those floors where hall enunciator lanterns are required separately for each direction, the incorporation of the position indicator into the hall lantern is not so easily achieved.

DISCLOSURE OF INVENTION

Objects of the invention include provision of an elevator hall enunciator lantern which provides adequate indication of car travel direction with light emanating from an area common to both directions.

According to the present invention, an elevator hall enunciator lantern has a single area containing dual-colored light disposed to illuminate the area in a first color to announce the impending arrival of an upwardly traveling elevator car and a second color to announce the impending arrival of a downwardly traveling elevator car.

In some cases, two different colors emanating from the same area will provide adequate indications of car direction in an elevator floor enunciator lantern; but such may not be the case because there may be passengers sufficiently color blind to be unable to adequately distinguish between the particular colors chosen for use in such a system. In accordance further with the invention, the dual-colored light may be selectively energized in one color to provide an upwardly pointing arrow indication to announce the impending arrival of upwardly traveling cars and energized in the other color to provide a downwardly pointing arrow indication to announce the impending arrival of downwardly traveling elevator cars. In accordance still further with the invention, the dual-colored light may be selectively lit in horizontal rows with successive rows being unlit in a scrolling fashion so as to simulate a wave traveling in the same direction (up or down) as the travel direction of the elevator being announced. In still further accord with the invention, both illumination in the configuration of an arrow and scrolling may be combined to ensure good visual queues of elevator car travel direction.

The invention permits utilizing a single kind of circuit which significantly reduces the number of spare parts that need be kept on hand. The invention permits utilizing two areas of an elevator hall enunciator lantern fixture for an enunciator and a position indicator. With the invention, a single escutcheon may be used for top, bottom and intermediate floors. Where position indicators are not required, the invention permits utilizing a smaller enunciator fixture, which reduces costs and enhances opportunity for architectural aesthetics. Since dual light LEDs are energized by separate leads, the voltage for the two different colors may be relatively adjusted so as to provide a relatively equal perception of intensity to the user. The invention is readily implemented with dual light LEDs which are commercially available.

Other objects, features and advantages of the present invention will become more apparent in the light of the following detailed description of exemplary embodiments thereof, as illustrated in the accompanying drawing.

BEST MODE FOR CARRYING OUT THE INVENTION

Figure 1:
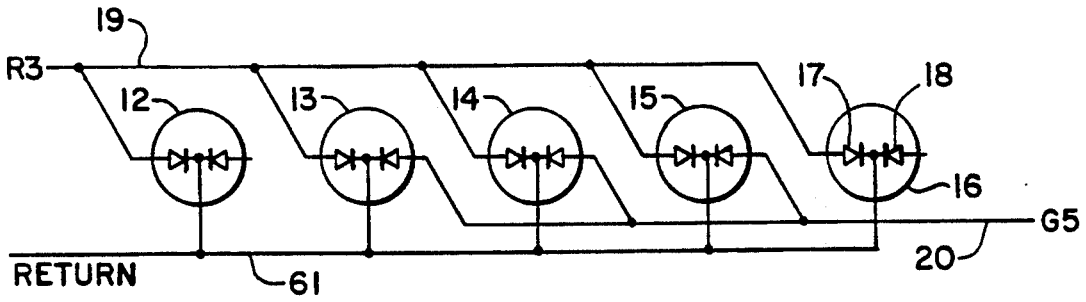
FIG. 1 is simplified schematic diagram of one row of a dual light hall lantern in accordance with the present invention.
Figure 2:
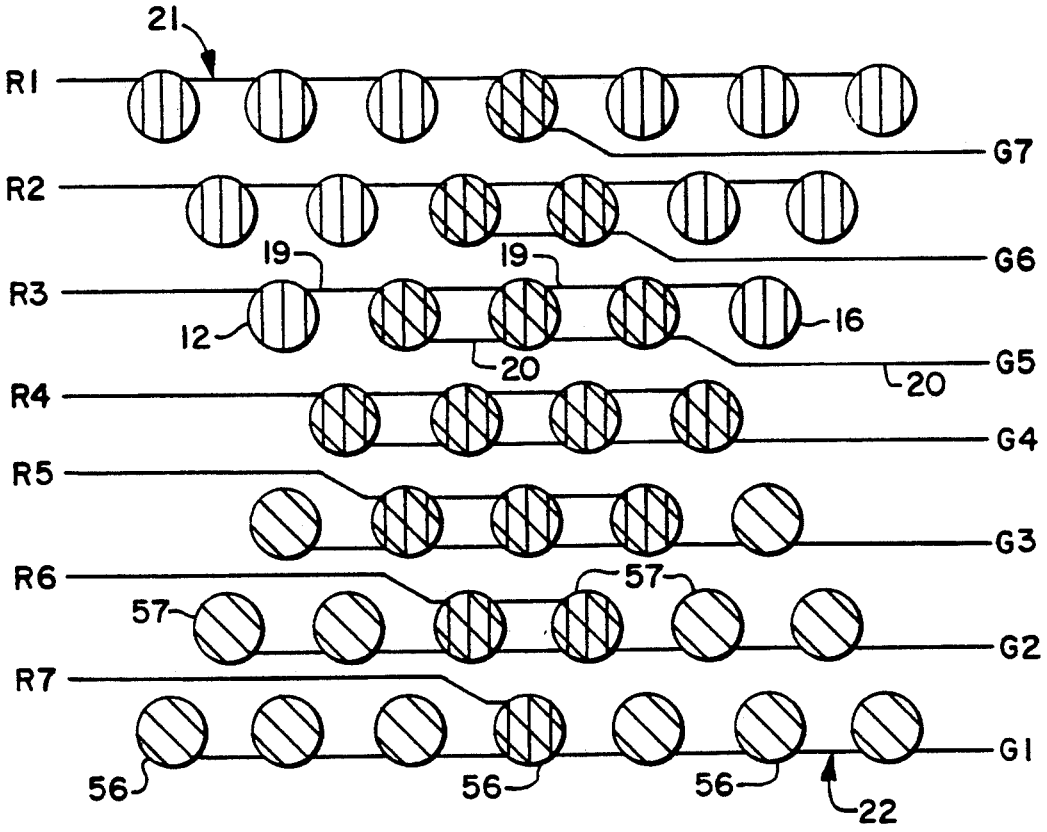
FIG. 2 is a simplified schematic illustration of an array of dual light LEDs forming distinctly colored upwardly and downwardly pointing arrows.

A plurality of dual light LEDs (light emitting diodes) 12–16 each include a diode 17 that emits red light and a diode 18 that emits green light. The dual light LEDs 12–16 may comprise AND/77RAG high intensity red/-green dual LEDs provided by A.N.D. Co., Burlingame, Calif., or any other suitable dual light, light emitting diodes. The diodes are selectively energized by voltage applied to corresponding lines 19, 20 to elicit emanation of either red or green color, respectively as desired in dependence upon the direction of travel of an elevator car which is being announced. The diodes 12–16 form the third row of a downwardly pointing red arrow 21 (FIG. 2) and the fifth row of an upwardly pointing green arrow 22 (FIG. 2). The line 19 is designated "R3" to indicate that it is the third row of a red array; similarly, the line 20 is designated "G5" to indicate it is the fifth row of a green array. In FIG. 2, the diodes in the downwardly pointing arrow 21 are indicated as emanating red light by vertical hatch lines; the diodes in the upwardly pointing arrow 22 are indicated as emanating green light by hatch lines at an angle; those that are selectively operated to glow in either color (such as the diodes 13–15 in FIG. 1) have both types of hatch lines therein. In FIG. 2, the rows are low numbered at the top for the downwardly pointing arrow and low numbered at the bottom for the upwardly pointing arrow. This indicates the direction of scrolling which can provide further indication of the direction being indicated by the illumination of the diodes (red or green, in this embodiment).

Figure 3:
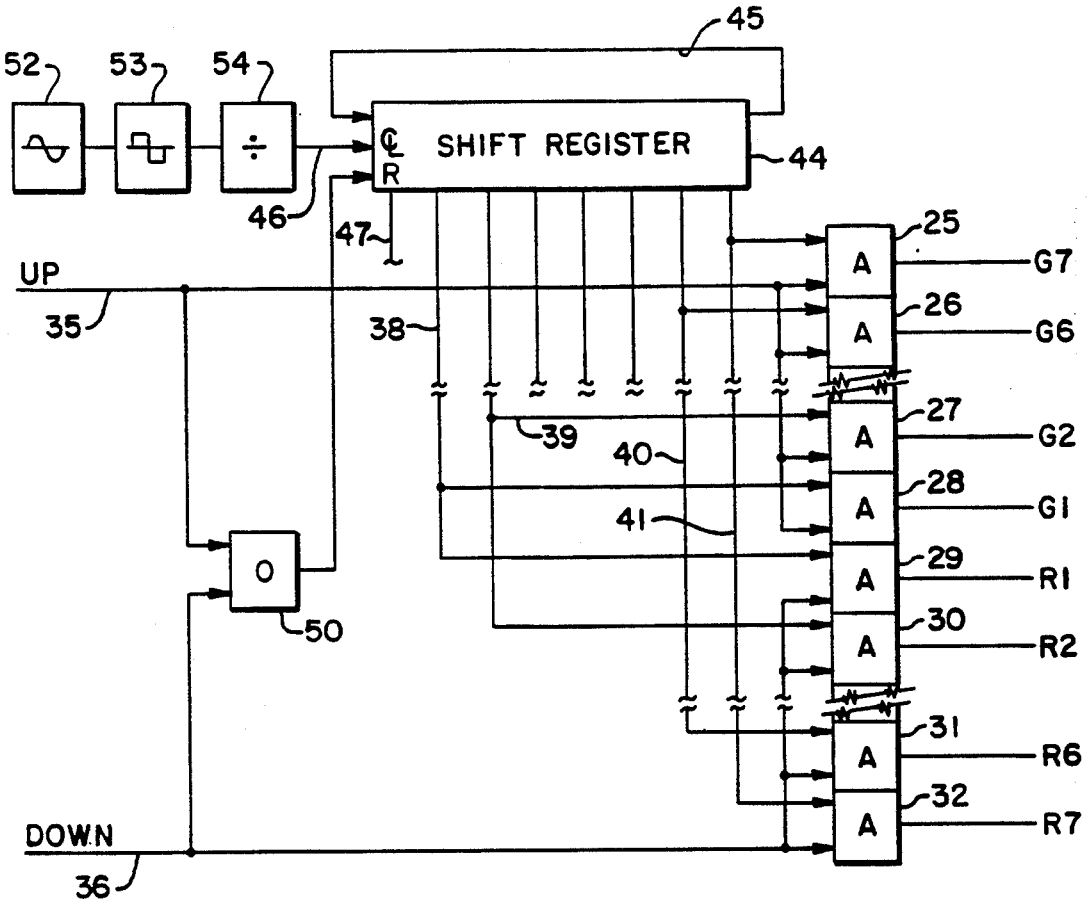
FIG. 3 is a simplified block diagram of an exemplary circuit for scrolling an LED array, such as that in FIG. 2 and FIGS. 4–8.

An example of how scrolling may be achieved is illustrated in FIG. 3. Therein, there is a plurality of AND gates 25–32 half of which 25–28 are utilized for illuminating rows of green diodes in the up arrow 22, and the other half of which 29–32 are utilized to energize red diodes in the downwardly pointing arrow 21. The green AND gates 25-28 are enabled in response to a hall lantern up signal on a line 35 from the elevator group controller indicating that the particular elevator is about to arrive and it is traveling in the up direction. Similarly, the red AND gates 29–32 are enabled in response to a corresponding down signal on a line 36. The other inputs to the AND gates cause them to operate one at a time, in succession, in response to a plurality of inputs 38–41 from a shift register 44. The shift register 44 is indicated as being in a wrap-around configuration by a line 45 so that as it continuously is gated through its clock input 46, it will step through providing a signal first on a line 47 and then on the inputs 38, 39 . . . 40, 41 to the various AND gates 25–32. For aesthetic purposes, the shift register can be made to initiate in each case in its first position thereby providing a signal on the line 47 which is not used which will cause all of the diodes in either of the arrows 21, 22 to initially be illuminated, as is described hereinafter. The initializing of the shift register to its first position upon the initiation of either the up signal on the line 35 or the down signal on the line 36 can be accomplished by applying a signal from an OR gate 50 to the reset input of the shift register 44. Clocking of the shift register is preferably achieved at approximately two to four times per second so as to give a definite indication of motion of the scrolling, for which it is desirable to both ensure that the scrolling motion occurs with each glance of the user's eye while at the same time it is slow enough so that the direction of scrolling is clearly perceived by the user. This scrolling can be caused by having an oscillator 52 feed a squaring circuit 53 (such as a Schmidt trigger) which in turn feeds a divider circuit 54, which may simply be a suitable digital counter, the terminal (or other) count of which is provided on the line 46 to clock the shift register.

In the embodiment shown, it is assumed that the polarity, or level, of the output of the shift register 44 is such that the unique signal which steps from one of its outputs to the next is of a nature to block the corresponding AND gate 25–32 such that when the shift register output is applied to a unique pair of AND gates (such as 25 and 32; 26 and 31) there will not be an output on the corresponding line (such as G7 or R7; G6 or R6). Thus, as an upwardly traveling elevator becomes committed to stop at the floor, the up signal appearing initially on the line 35 will enable all of the gates 25–28 because the shift register is at the same time initiated by the OR circuit 50 at its initial state providing an output on the line 47. The very next clock signal however will cause a signal on the line 38 which will block the lowest row (G1) of the green arrow 22 (FIG. 2) so that the diode 56 will become unlit. The third clock signal will cause an output on line 39 to block the AND circuit 27 so that diodes 57 in row G2 will become unilluminated whereas the remaining rows G3–G7 will remain illuminated and row G1 will become illuminated. Thus, the non-illumination will scroll successively upwardly through the upward pointing green arrow, and this will continue so long as the up signal is present in the line 35. Thus, any time the user glances at the direction indicator there will be both an arrow pointing upward and an upwardly scrolling dark row to indicate that the direction is upward. Therefore, if the user is unable to distinguish the color, there is provided in this embodiment two other indications of the direction of travel of the soon to arrive elevator car.

It is not necessary to have both an arrow configuration indicating direction and scrolling to indicate direction. In an upscale elevator system, this can be very aesthetic and therefore may be desirable. It also can be desirable to provide a greater assurance of a clear direction indication in elevator systems which may not get proper maintenance. Thus, before scrolling and arrow directions would be not deciphered, there would have to be a fairly severe deterioration of the circuit containing the apparatus of FIG. 2 and FIG. 3.

Figure 4:
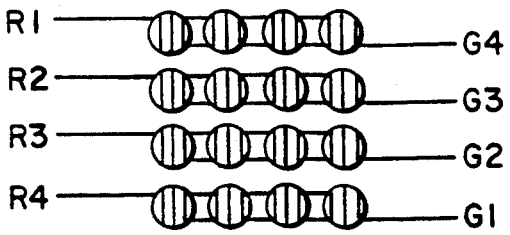
FIGS. 4–8 are simplified diagrams illustrating scrolling to indicate arriving car direction.
Figure 5:
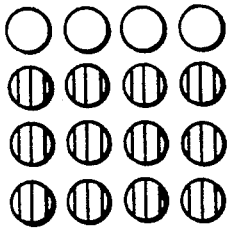
Figure 6:
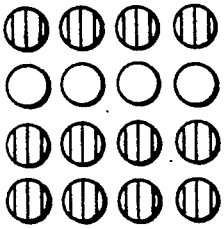
Figure 7:
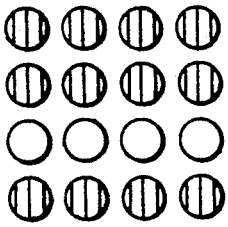
Figure 8:
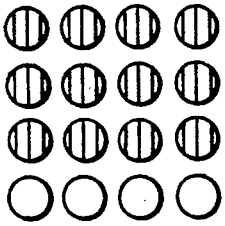

FIGS. 4–8 illustrate an embodiment of the invention which does not configure the LEDs in upward and downward pointing arrows, but simply in rectangular arrays. FIGS. 4–8 also illustrate more clearly the concept of dark row scrolling to indicate direction in which the succession of dark rows advances downwardly. In FIG. 4, all of the diodes are indicating as glowing red; this might be the case when the down line 36 first becomes energizing causing four of the AND circuits (such as 29, 30) to be energized thus energizing all four rows of the array. In FIG. 5, the first row has been de-energized and is dark because the AND gate 29 (for instance) will have been blocked by an output on the line 38 from the shift register 44; however, the remaining three rows are glowing red. In FIG. 6, the second row is dark which occurs because the AND gate 30 is de-energized by a signal on the line 39 from the shift register 44; however, rows 1, 3 and 4 are glowing red. In FIG. 7, the third row is dark and rows 1, 2 and 4 are glowing red. In FIG. 8, the first three rows are glowing red and the fourth row is dark. In the next time frame, all four rows would again be glowing red (FIG. 4) because of a wrap around in a five stage shift register (not shown, similar to the eight stage shift register illustrated in FIG. 3). Thus, FIGS. 4–8 illustrate how dark row scrolling in an appropriate direction can provide an indication of direction so that color distinction is not essential in each user.

Figure 9:
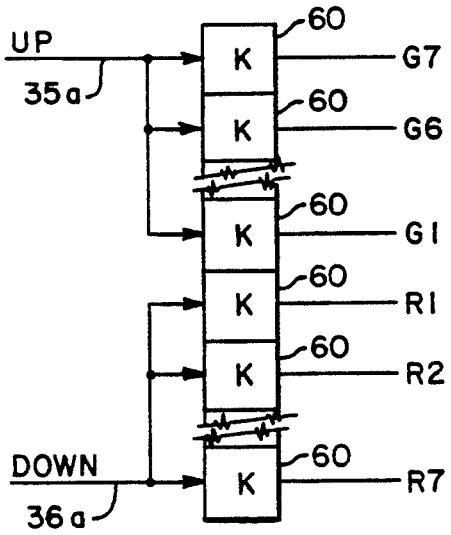
FIG. 9 is a simplified diagram of driving circuits which do not scroll the array.

The red arrow 21 and the green arrow 22 illustrated in FIG. 2 need not be scrolled as described hereinbefore in any use of the invention where scrolling is not desired. Instead, all of the red leads R1–R7 within the down pointing arrow 21 may be energized constantly whenever a down signal is present on the line 36*a* (FIG. 9) and all of the green leads G1–G7 within the up pointing arrow 22 may be energized constantly whenever there is an up signal on a line 35*a*. This can be achieved simply by providing suitable amplification or isolation, as necessary, as indicated by a plurality of amplifiers 60 in FIG. 9. Alternatively, the leads R1–R7 could all be connected together and the leads G1–G7 could all be connected together, and fed by a pair of related amplifiers, when suited to a given implementation of the present invention. Thus, the dual light LEDs may be utilized in accordance with the present invention in an arrow configuration as illustrated in FIG. 2, in ordinary orthogonal configuration as illustrated in FIG. 6, with scrolling as indicated in FIGS. 4–8 or without scrolling, as indicated by the circuit of FIG. 9.

The dual light LEDs will typically be mounted behind a glass lens or jewels within an elevator hall enunciator fixture. In current fixtures having a place for an uplight and a downlight, the use of the present invention will free an area which can be used for another purpose, such as for a position indicator. On the other hand, the invention may be implemented in lantern fixtures which do not have a position indicator or other function therein. The invention may be used with or without chimes or bells, as suits any utilization thereof.

When scrolling is used, the manner of achieving it is irrelevant to the present invention. Although a shift register has been shown, the scrolling can be effected merely by decoding appropriately the outputs of a counter such as the counter 54 so as to cause a correct stepping effect in order to provide an indication of the direction which is desired. Two dark rows can be scrolled instead of one; either adjacent rows or rows spaced from each other. Or, the lit rows (one, two, or more, adjacent or separated) may be scrolled. Although FIGS. 4–8 illustrate scrolling by having successive adjacent rows dark, the successive dark rows need not be adjacent, so long as direction is readily differentiated. Similarly, the stepping effect required for a scrolling indication may be achieved by selectively blocking out the return line 61 (FIG. 1) of a selected row, while the lines 19 or 20 as is appropriate of all of the rows R1–R7 or G1–G7 are energized together. Thus neither the nature of the apparatus used to cause the stepping effect, nor the manner of applying it to the diodes so that scrolling will occur, are material to the invention. FIGS. 4–8 illustrate an array of sixteen dual light, LEDs; however, an array of thirty or sixty or so is more likely.

Thus, although the invention has been shown and described with respect to exemplary embodiments thereof, it should be understood by those skilled in the art that the foregoing and various other changes, omissions and additions may be made therein and thereto, without departing from the spirit and scope of the invention.

I claim:

1. A direction indicating, elevator hall enunciator lantern, comprising:

three groups of dual light, light emitting diodes disposed in the lantern in a manner to provide visible light to users in the hall each of said diodes having two separate electrical connections, the application of electrical power to a first one of said connections causing said diodes to provide light of a first color and the application of electrical power to a second one of said connections causing said diodes to provide light of a second color different from said first color;

a first group and a second group of said diodes arranged in an array to form an arrow pointing in a first direction of elevator travel, and said second group and a third group of said diodes arranged in an array to form an arrow pointing in a second direction of elevator travel which is opposite to said first direction;

first circuitry connected to said first connections of said first and second groups of diodes and responsive to a signal provided to said lantern indicative of the impending arrival of an elevator car traveling in said first direction for applying electrical power to said first electrical connections so as to cause said first and second groups of diodes to emit light of said first color, said second connections of said first group of diodes being not connected to any circuitry; and second circuitry connected to said second connections of said second and third groups of diodes and responsive to a signal provided to said lantern indicative of the impending arrival of an elevator car traveling in said second direction for applying electrical power to said second connections so as to cause said second and third groups of diodes to emit light of said second color, said first connections of said third group of diodes being not connected to any circuitry.

2. An elevator hall lantern according to claim 1 wherein said arrays consist of horizontal rows of diodes and said circuitry causes different rows of said arrays to be not lit during the period of time that said signal indicative of an elevator car approaching in a given direction is present, in a succession of rows advancing in the same direction as the direction of travel of the approaching elevator car being announced, whereby the display of light by said diodes is scrolled in a direction to provide an additional indication of the direction in which said elevator car is traveling.

* * * * *